United States Patent [19]

Hammelmann

[11] 4,173,806

[45] Nov. 13, 1979

[54] APPARATUS FOR CLEANING CONDUITS OR THE LIKE

[76] Inventor: Paul Hammelmann, Zum Sundern 17, D-4740 Oelde 1, Fed. Rep. of Germany

[21] Appl. No.: 952,539

[22] Filed: Oct. 18, 1978

[30] Foreign Application Priority Data

Oct. 18, 1977 [DE] Fed. Rep. of Germany ..... 2746668
Apr. 26, 1978 [DE] Fed. Rep. of Germany ..... 2818182

[51] Int. Cl.[2] ..... B08B 9/04
[52] U.S. Cl. ..... 15/104.06 R; 15/104.07
[58] Field of Search ..... 15/104.06 R, 104.06 A, 15/104.07

[56] References Cited

U.S. PATENT DOCUMENTS 2,163,384 6/1939 Stevens ..... 15/104.07
2,601,614 6/1952 Johnson ..... 15/104.07 X

*Primary Examiner*—Edward L. Roberts
*Attorney, Agent, or Firm*—Peter K. Kontler

[57] ABSTRACT

Apparatus for cleaning straight or arcuate conduits has a housing which fits with clearance into a conduit and has an elastic washer slidably engaging the internal surface of the conduit so that the pressure of a fluid which fills the conduit behind the housing propels the housing forwardly until the housing encounters an incrustation or another obstruction. The housing contains a reciprocable impeller which can strike against the housing under the action of a spring to thereby cause a set of cutting tools at the exterior of the housing and in front of the washer to break up or strip off the obstruction. The impeller is cocked by a hollow plunger which has a flow-restricting end wall for admission of pressurized fluid into the internal space of the housing and moves rearwardly when the internal space is free to communicate with the conduit portion ahead of the housing by way of outlet openings which are provided in the housing and are normally sealed by a reciprocable valve which is biased to its operative position by a spring.

22 Claims, 3 Drawing Figures

APPARATUS FOR CLEANING CONDUITS OR THE LIKE

BACKGROUND OF THE INVENTION

The present invention relates to improvements in fluid-propelled apparatus for cleaning the internal surfaces of tubular bodies, such as pipes, conduits or like hollow structures which serve to convey or confine gaseous, liquid or flowable solid substances in industrial plants, residential areas or elsewhere. More particularly, the invention relates to apparatus for removing incrustations or other impurities or obstructions which adhere to the internal surfaces of hollow tubular bodies (hereinafter called conduits) by means of one or more cutting implements which are urged into engagement with the internal surface of the conduit.

It is already known to provide a composite (multipiece) conduit- or pipe-cleaning apparatus with a device which propels the housing of the apparatus forwardly. The propelling device is mounted behind several cutting implements which are articulately connected to each other as well as to the propelling device. A drawback of such apparatus is that the articulately interconnected parts are likely to lie askew and to cause the apparatus to jam in the interior of a conduit. In many instances, presently known cleaning apparatus employ devices which cause the liquid behind the housing of the apparatus to apply to the housing blows and to thus promote partial or complete removal of incrustations or other impediments in the interior of the conduit. The impulses which are applied by the liquid are relatively weak because substantial amounts of pressurized liquid which fills the conduit behind the housing of the apparatus are permitted to penetrate into the front or downstream portion of the conduit. In other words, the entire kinetic energy of pressurized liquid (normally water) cannot be utilized to promote the removal of obstructions by the cutting implements of the apparatus.

OBJECTS AND SUMMARY OF THE INVENTION

An object of the invention is to provide a novel and improve apparatus which can be propelled through a conduit by pressurized fluid and which is constructed and assembled in such a way that it can remove incrustations or other obstructions from the internal surfaces of straight, arcuate or partly straight and partly arcuate conduits.

Another object of the invention is to provide an apparatus wherein the entire or practically entire kinetic energy of pressurized fluid behind the housing of the apparatus is utilized or can be utilized to promote rapid and efficient removal of obstructions from the internal surface of a straight or arcuate conduit or another hollow tubular body.

A further object of the invention is to provide novel and improved means for applying blows or impacts to the housing of the apparatus to thus enhance the breaking, comminuting, cutting and material removing action of implements which engage the internal surface of the conduit and bring the apparatus to a temporary halt or decelerate the apparatus during forward movement in response to the pressure of a fluid in the upstream portion of the conduit.

An additional object of the invention is to provide an apparatus which can impart to the cutting implements any desired number of successive blows or impacts until the obstruction or obstructions which interfere with forward movement of the apparatus or reduce the speed of forward movement of the apparatus are segregated from the internal surface of the conduit.

Another object of the invention is to provide an apparatus which is sufficiently compact to move from a straight into an arcuate conduit, from an arcuate into a straight conduit or from a conduit having a first curvature into a conduit having a different second curvature.

The invention is embodied in a fluid-propelled apparatus for cleaning or freeing conduits of the type having an upstream portion adapted to be filled with a pressurized fluid (e.g, water) and an open downstream portion. The apparatus comprises a housing which is insertable into the conduit between the upstream and downstream portions of the conduit and includes a component (e.g., an elastic washer) which slidably engages the internal surface of the conduit so that pressurized fluid in the upstream portion of the conduit acts upon the component and normally propels the housing forwardly until the housing is arrested or decelerated by an obstruction (e.g., an incrustation on the internal surface of the conduit), if any, in the downstream portion of the conduit, an internal space provided in the housing and communicating with the upstream portion of the conduit so that the pressure of fluid in the internal space normally matches or approximates the pressure in the upstream portion, outlet means provided in the housing and connecting the internal space with the downstream portion of the conduit, valve means movable in or on the housing to and from an operative position in which the outlet means is sealed, a helical spring or other suitable first biasing means for urging the valve means to the operative position, at least one cutting tool or implement pivotably mounted on the housing in front of the component and serving to remove or break up obstructions in the downstream portion of the conduit in response to application of impacts to the housing, impeller means (e.g., a piston) reciprocably mounted in the housing, a preferably hollow plunger reciprocably mounted in the housing behind the impeller means to move rearwardly under the action of pressurized fluid in the internal space of the housing when the housing is decelerated or arrested and forwardly under the action of pressurized fluid in the upstream portion of the conduit when the internal space of the housing communicates with the downstream portion of the conduit by way of the outlet means, a strong helical spring or other suitable second biasing means for urging the impeller means forwardly to impact against the housing and to thus enable the cutting tool or tools to break up or scrape off the obstruction or obstructions in the downstream portion of the conduit immediately ahead of or around the housing, and a set of spheres or other suitable rolling or otherwise configurated elements for respectively coupling the impeller means with the plunger and with the valve means prior to rearward movement of the plunger and upon completion of rearward movement of the plunger so that the valve means leaves the operative position while the impeller means moves forwardly under the action of the second biasing means (upon completion of rearward movement of the plunger with the impeller means) to impact against the housing and the first biasing means returns the valve means to the operative position upon completion of forward movement of the plunger.

The internal space of the housing preferably communicates with the upstream portion of the conduit by way of a flow-restricting apertured rear end wall which forms part of the plunger, and such rear end wall may constitute a retainer against which the second biasing means reacts to urge the impeller means forwardly.

The front and/or rear portion of the apparatus is preferably bullet-shaped or conical so that the housing can readily advance from a straight conduit into an arcuate conduit, from an arcuate conduit into a straight conduit, in an arcuate conduit having a constant curvature or in a meandering or otherwise configurated conduit having a curvature which varies from section to section.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

A straight conduit 1 which is to be cleaned by the apparatus of the present invention is shown by phantom lines. A second conduit 2 which is of arcuate shape and which, too, can be cleaned by the improved apparatus, is also indicated by phantom lines. The apparatus is relatively short and its ends are conical; therefore, it can be readily caused to move forwardly, either in the conduit 2, in the conduit 1, from the conduit 1 into the conduit 2, or from the conduit 2 into the conduit 1. The term "short" is intended to denote the dimensions of the apparatus as considered in the longitudinal direction of the conduit 1 or 2.

Figure 1:
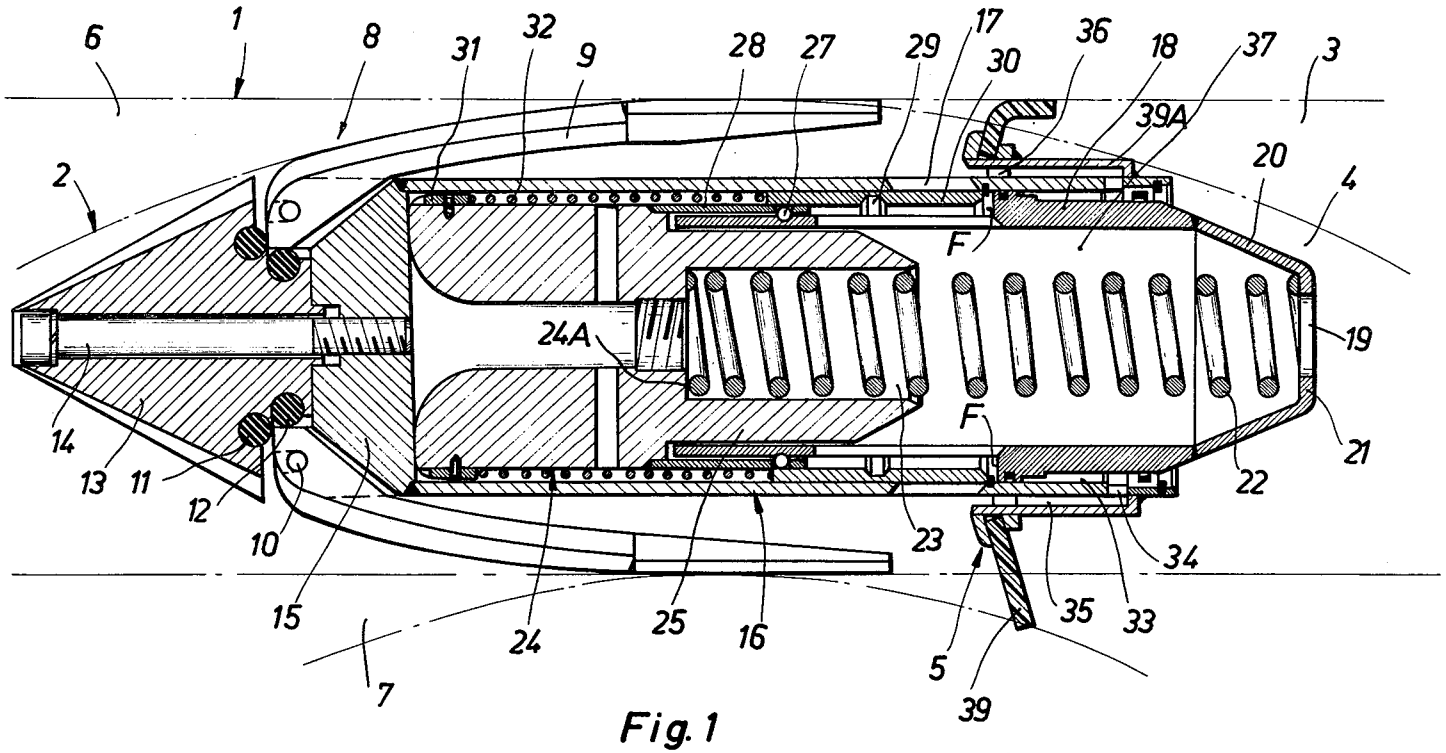
FIG. 1 is an axial sectional view of an apparatus which embodies one form of the invention, the parts of the apparatus being shown in positions they assume when the apparatus is free to move fowardly in a straight or arcuate conduit.

The upstream portion 3 of the conduit 1 or the upstream portion 4 of the conduit 2 behind an elastically deformable external conduit-engaging component 5 of the apparatus is filled with a pressurized fluid (normally water or another liquid) which serves to propel the apparatus forwardly, i.e., in a direction to the left, as viewed in the drawing. The component 5 comprises an elastic washer 39 which engages and is slidable along the internal surface of the conduit 1 or 2. FIG. 1 shows the lower portion of the washer 39 in engagement with the internal surface of the conduit 2 and the upper portion of the same washer in engagement with the internal surface of the conduit 1. When the apparatus does not encounter any obstacles or encounters obstructions which can be readily removed from the internal surface of the conduit 1 or 2, the pressure of liquid upon the rear side of the washer 39 suffices to propel the apparatus forwardly. The apparatus then advances into the front or downstream portion 6 or 7 of the conduit 1 or 2. The downstream portions 6 and 7 of the conduits 1 and 2 are open at their front ends so that the liquid which flows or leaks through the apparatus can sweep away any impurities (particularly incrustations which are removed from the internal surface of the conduit 1 or 2) by flowing forwardly and through the open front end of the downstream portion 6 or 7. The pressure of liquid in the portions 6 and 7 suffices to advance the impurities at the speed of forward movement of the apparatus.

The means for removing incrustations from the internal surface of the conduit 1 or 2 comprises an annulus or group 8 of pivotable knives or chisels 9 or analogous cutting implements or tools. The front end portions of the knives 9 are pivotable about pins 10 which are secured to the separable conical front end portion or tip 13 of the apparatus housing. The axes of the pins 10 are normal to the direction of forward movement of the apparatus so that the knives 9 can pivot in radial planes which include the longitudinal axis of the apparatus. The means for pivoting or biasing the rear end portions of the knives 9 radially outwardly comprises two elastic rings 11 and 12 which are recessed into the front end portion 13 adjacent to the pivot pins 10. The front end portion 13 is separably connected with the hollow main portion 16 of the housing (and more particularly with a disk-shaped front end wall 15 of the main portion 16) by means of a bolt 14. The main portion 16 of the housing has outlet openings 17 which are located in front of the washer 39.

The main portion 16 of the housing contains a reciprocable hollow plunger 18 with a rear end wall 21 having a centrally located liquid-admitting inlet aperture 19 whose cross-sectional area is less than the combined cross-sectional area of outlet openings 17, i.e., the end wall 21 can be said to constitute a restrictor for the flow of liquid which fills the upstream portion 3 or 4 of the conduit 1 or 2. The end wall 21 is disposed at the rear end of a hollow conical portion 20 of the plunger 18. A biasing means in the form of a strong helical spring 22 in the interior of the main housing portion 16 reacts against the end wall 21 and bears against an internal shoulder 24A of an impact-applying piston-like impeller 24 which has a bore 23 in its rear end face for reception of the front portion of the spring 22. The hollow impeller portion 25 which surrounds the bore 23 is surrounded by the apertured tubular or cylindrical front end portion of the plunger 18 which latter is slidable relative to the impeller 24. The front portion of the plunger 18 has a recess in the form of a circumferential groove 26 for portions of rolling coupling elements in the form of spheres 27. These spheres serve to couple the plunger 18 to the impeller 24 during certain stages of operation of the apparatus.

The impeller 24 includes or is connected with a cylindrical wall 28 which constitutes a cage for the spheres 27 and from which the inner portions of the spheres extend into the circumferential groove 26. The outer portions of the spheres 27 can enter a second recess here shown as an internal annular groove 29 of a reciprocable cylindrical valve 30 for normally sealing the outlet openings 17 in the main housing portion 16. The valve 30 is a tubular body which is slidably guided by and surrounds the cylindrical wall 28. A biasing means here shown as a helical spring 32 is interposed between the front end face of the valve 30 and a ring-shaped stop 31 which surrounds and is secured to the front end portion of the impeller 24. The spring 32 stores energy in response to a reduction of the distance between the stop 31 and the valve 30 and then tends to propel the valve rearwardly, i.e., to the operative position in which the outlet openings 17 are sealed. The thickness of the wall 28 is less than the diameters of the spheres 27 and each of these spheres is confined in a discrete opening of the wall 28.

The median portion of the plunger 18 is surrounded by an annular chamber 33 which is defined by the housing portion 16 and whose rear portion communicates with ports 34 machined into the main housing portion 16. The outer ends of the ports 34 communicate with an annular compartment 35 between the external surface of the main housing portion 16 and a cylindrical sleeve 39A which carries the deformable washer 39. The front end portion of the compartment 35 communicates with the downstream portion 6 or 7 of the conduit 1 or 2 by way of channels 36 between the housing portion 16 and the sleeve 39A. Thus, the pressure in the compartment 35 is less than the pressure of liquid which fills the upstream portions 3 and 4 of the conduits 1 and 2. The chamber 33 is in communication with the upstream portion 3 or 4 of the conduit 1 or 2. Those parts of the housing portion 16 which define the chamber 33, ports 34, compartment 35 and channels 36 can be said to define a path along which controlled quantities of liquid can leak from the upstream portion 3 or 4 into the downstream portion 6 or 7 of the conduit 1 or 2 independently of the position of the valve 30.

When the apparatus is free to move forwardly, i.e., when the surface surrounding the downstream portion 6 or 7 of the conduit 1 or 2 does not carry incrustations which adhere thereto with a substantial force, the apparatus moves forwardly under the action of pressurized liquid which fills the upstream portion 3 or 4 of the conduit 1 or 2. When the apparatus encounters a pronounced resistance to further forward movement, i.e., when the apparatus is decelerated or arrested, the pressure of liquid in the internal space 37 of the hollow plunger 18 (this is also the internal space of the housing portion 16) increases and such pressurized fluid acts upon the internal surface F of the plunger 18 and moves the plunger 18 (together with the impeller 24 which is coupled to the plunger by the spheres 27) in a direction to the right, as viewed in FIG. 1. The spring 22 stores energy whenever the plunger 18 is coupled to the impeller 24.

Figure 2:
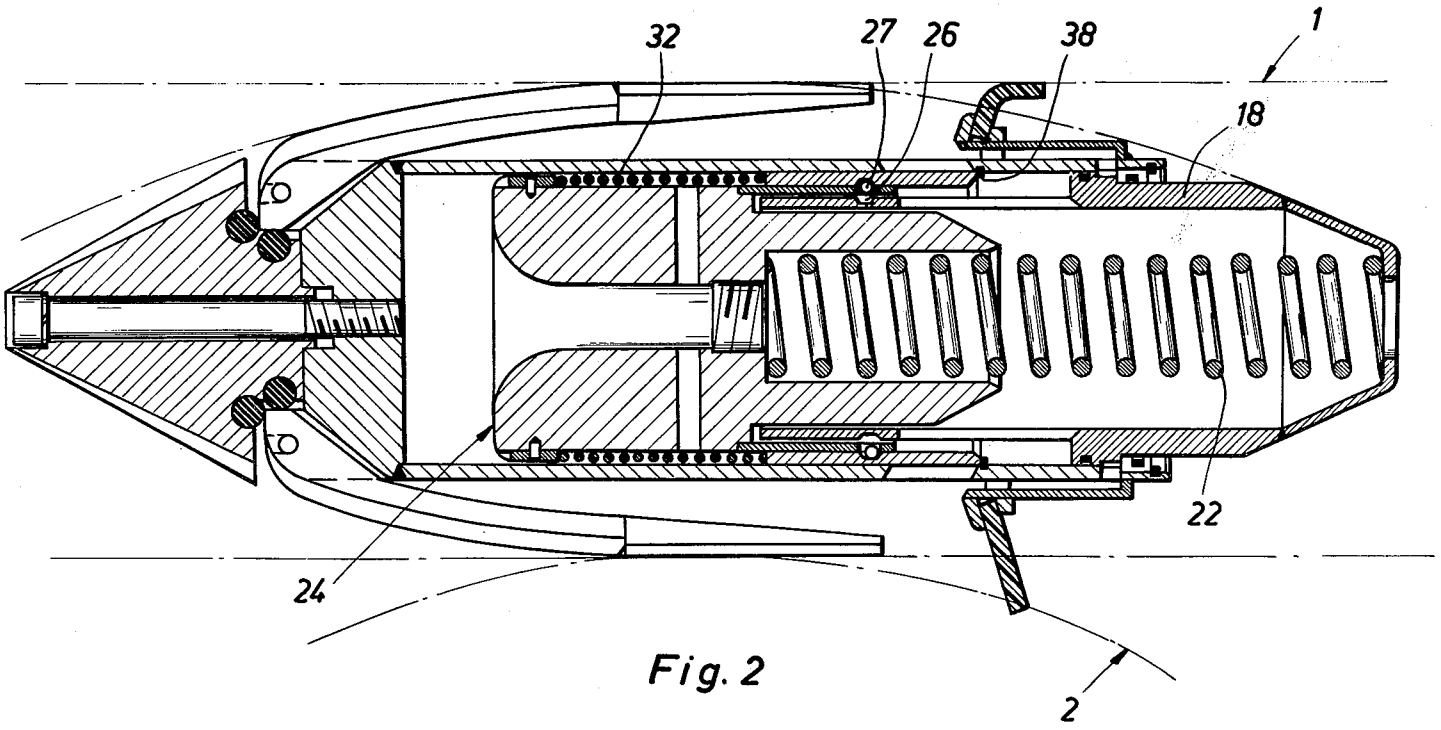
FIG. 2 shows the apparatus of FIG. 1, with the impeller in retracted or cocked position.
Figure 3:
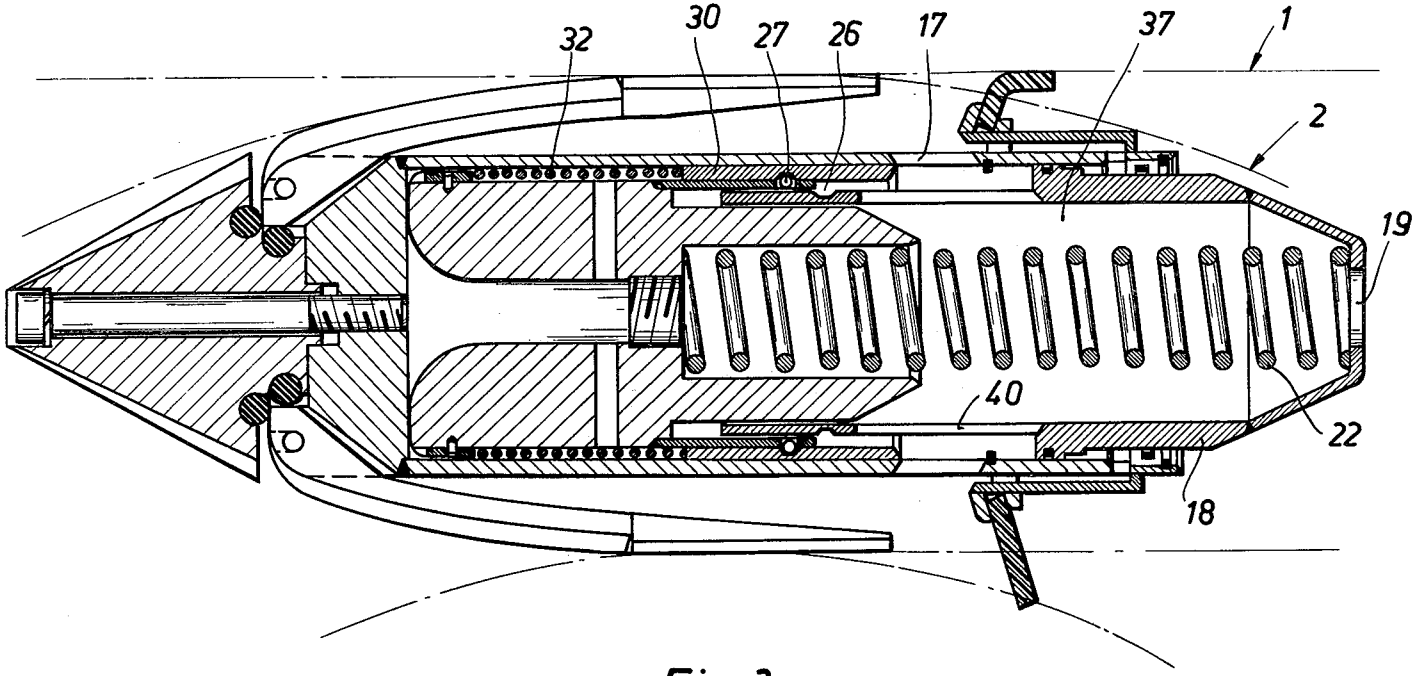
FIG. 3 shows the apparatus of FIG. 1, with the impeller in the front end position in which it is detached from the valve means so that the latter is free to move to the operative position.

As the parts 18 and 24 move in response to the action of pressurized fluid against the internal surface F, the spring 32 sotres energy because the stop 31 moves toward the valve 30. The valve 30 abuts against a ring-shaped arresting element or seat 38 in the main housing portion 16. The arresting element 38 is adjacent to the outlet openings 17. When the parts 18 and 24 reach the rear end positions of FIG. 2, the groove 29 registers with the spheres 27 so that it receives portions of the spheres under the action of the spring 22 which is then free to propel the impeller 24 forwardly and to cause the impeller to impact or strike against the front end wall 15 so as to advance or attempt to advance the entire apparatus in the forward direction. The spheres 27 have entered the internal groove 29 of the valve 30 so that the valve 30 is coupled to the impeller 24 and shares its forward movement. That position of the impeller 24 in which the latter strikes against the end wall 15 is shown in FIG. 3. The valve 30 has been moved forwardly and beyond the outlet openings 17 so that the openings 17 discharge fluid from the space 37 into the downstream portion 6 or 7 of the conduit 1 or 2.

Since the apertured rear end wall 21 of the plunger throttles the flow of pressurized fluid into the internal space 37, the pressure of fluid in the upstream portion 3 or 4 of the conduit 1 or 2 causes the plunger 18 to move forwardly with respect to the housing portion 16 and impeller 24, i.e., the spring 22 stores energy. When the circumferential groove 26 reaches the internal groove 29, the spring 32 expands and causes the spheres 27 to enter the groove 26 while simultaneously propelling the valve 30 into engagement with the arresting element 38 so that the valve seals the outlet openings 17 from the internal space 37, i.e., the parts of the apparatus reassume the positions which are shown in FIG. 1. The just described operation is repeated as often as necessary in order to cause the knives 9 to cut through or remove the obstruction in the downstream portion 6 or 7 and to thus enable the apparatus to move forwardly under the action of pressurized fluid upon the washer 39.

The reference character 40 denotes the apertures in the median portion of the plunger 18. These apertures enable the fluid to flow from the internal space 37 of the housing portion 16 and plunger 18 into the outlet openings 17 in the open or inoperative position of the valve 30. The valve 30 moves forwardly with the impeller 24 to allow the fluid to flow from the space 37 into the downstream portion 6 or 7 of the conduit 1 or 2. This enables the plunger 18 to move forwardly in response to the pressure of fluid in the conduit portion 3 or 4 and to be coupled with the impeller 24 upon completion of such forward movement. Coupling of the plunger 18 to the impeller 24 enables the spring 32 to return the valve 30 to the operative position and this, in turn, enables the fluid which flows into the space 37 via aperture 19 to act upon the shoulder or surface F and to move the plunger 18 rearwardly. The impeller 24 shares such movement and is cocked to apply a blow against the housing portion 16 as soon as the rearward movement of the plunger 18 is completed, i.e., as soon as the impeller 24 is uncoupled from the plunger (this takes place simultaneously with coupling of the impeller to the valve 30).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Fluid-propelled apparatus for cleaning conduits of the type having an upstream portion adapted to be filled with a pressurized fluid and an open downstream portion, comprising a housing insertable into the conduit between said portions and including a component slidably engaging the internal surface of the conduit so that pressurized fluid acts upon said component and normally propels said housing forwardly until the housing is arrested or decelerated by an obstruction, if any, in said downstream portion, said housing having an internal space communicating with said upstream portion and outlet means connecting said space with said downstream portion; valve means movable in said housing to and from an operative position in which said outlet means is sealed; first biasing means for urging said valve means to said operative position; at least one cutting tool mounted on said housing in front of said component and arranged to remove or break up the obstructions in said downstream portion on application of impacts to said housing; impeller means reciprocably mounted in said housing; a plunger reciprocably mounted in said housing behind said impeller means to move rearwardly under the action of pressurized fluid in said space on deceleration or stoppage of said housing and forwardly under the action of fluid pressure in said upstream portion when said space communicates with said downstream portion via said outlet means; second biasing means for urging said impeller means forwardly to impact against said housing; and means for respectively coupling said impeller means with said plunger and with said valve means prior to rearward movement and upon completion of rearward movement of said plunger so that said valve means leaves said operative position against the opposition of said first biasing means while said impeller moves forwardly under the action of said second biasing means upon completion of rearward movement of said plunger to impact against said housing and said first biasing means returns said valve means to said operative position upon completion of forward movement of said plunger.

2. The apparatus of claim 1, wherein said valve means is coaxial with said impeller means and is reciprocable in said housing.

3. The apparatus of claim 1, wherein said second biasing means reacts against said plunger so that it stores energy while said plunger moves forwardly.

4. The apparatus of claim 1, wherein said plunger is hollow and its interior communicates with said space, said plunger having inlet means connecting said upstream portion with said space.

5. The apparatus of claim 4, wherein said plunger includes a forward portion slidably surrounding a portion of said impeller means.

6. The apparatus of claim 4, wherein said second biasing means comprises a spring reacting against said plunger and bearing against said impeller means.

7. The apparatus of claim 4, wherein said valve means includes a portion which slidably surrounds a portion of said impeller means and said first biasing means comprises a spring reacting against said impeller means and bearing against said valve means to urge the latter to said operative position.

8. The apparatus of claim 1, wherein said coupling means comprises at least one rolling element confined in said impeller means, a first recess provided in said plunger to receive a portion of said rolling element upon completion of forward movement of said plunger, and a second recess provided in said valve means to receive a portion of said rolling element upon completion of rearward movement of said plunger, said rolling element extending into one of said recesses at a time so that it couples said impeller means to said plunger during rearward movement of said plunger and to said valve means upon completion of rearward movement of said plunger.

9. The apparatus of claim 1, further comprising means for arresting said valve means in said operative position against the action of said first biasing means.

10. The apparatus of claim 1, wherein said plunger includes an end wall remote from said impeller means and a hollow conical wall tapering rearwardly toward said end wall, said second biasing means including resilient means reacting against said end wall and bearing against said impeller means.

11. The apparatus of claim 10, wherein said impeller means includes a rear portion having a bore for a portion of said resilient means.

12. The apparatus of claim 1, wherein said housing includes means defining at least one path for the leakage of fluid from said upstream portion to said downstream portion independently of the position of said valve means.

13. The apparatus of claim 12, wherein said path defining means has a chamber surrounding said plunger.

14. The apparatus of claim 13, wherein said chamber communicates with said upstream portion, said path defining means further having a compartment, port means communicatively connecting said compartment with said chamber, and channel means communicatively connecting said compartment with said downstream portion.

15. The apparatus of claim 12, wherein said path defining means includes a sleeve forming part of said housing and surrounding said plunger, said component being mounted on said sleeve.

16. The apparatus of claim 15, wherein said component is an elastic washer.

17. The apparatus of claim 1, wherein said impeller means comprises a substantially cylindrical wall and said coupling means comprises spheres mounted in openings provided therefor in said wall, the thickness of said wall being less than the diameters of said spheres, said plunger including a tubular front portion extending into said wall and having an external groove for portions of said spheres, said valve means having a tubular portion surrounding said wall and having an internal groove for portions of said spheres.

18. The apparatus of claim 17, wherein said wall is respectively coupled to said valve means and said plunger when portions of said spheres respectively extend into said internal and said external grooves, said portions of said spheres extending into said external groove on completion of forward movement of said plunger and during rearward movement of said plunger and said portions of said spheres extending into said internal groove upon completion of rearward movement of said impeller means with said plunger and during ensuing forward movement of said impeller means under the action of said second biasing means.

19. The apparatus of claim 1, wherein said plunger comprises flow restrictor means defining inlet means communicatively connecting said space with said upstream portion.

20. The apparatus of claim 19, wherein the cross-sectional area of said outlet means exceeds the cross-sectional area of said inlet means.

21. The apparatus of claim 1, wherein said housing comprises a forwardly tapering front end portion.

22. The apparatus of claim 1, wherein said plunger comprises a rearwardly tapering rear portion extending from said housing and into said upstream portion.

* * * * *